United States Patent [19]

Boyd

[11] 4,175,294

[45] Nov. 27, 1979

[54] TOILET CONSTRUCTION

[76] Inventor: John A. Boyd, 5535 Columbia Pike, Arlington, Va. 22204

[21] Appl. No.: 940,703

[22] Filed: Sep. 8, 1978

[51] Int. Cl.[2] ..... A47K 13/00

[52] U.S. Cl. ..... 4/237; 4/234

[58] Field of Search ..... 4/237, 239, 234, 300, 4/420, 238, 235, 329, 330, 418

[56] References Cited

U.S. PATENT DOCUMENTS

| | | | |
|---|---|---|---|
| 951,604 | 3/1910 | Fuller | 4/300 |
| 2,099,118 | 11/1937 | Kennedy | 4/420 |
| 3,520,005 | 7/1970 | Downes | 4/234 |

*Primary Examiner*—Henry K. Artis

[57] ABSTRACT

An improved toilet construction uses a bulbous upwardly rounded portion at the forward end of a toilet seat to raise the user's thighs angularly upward from a horizontal position and an angled foot engaging means at the lower forward portion of the toilet bowl to raise the user's feet angularly upwardly from a horizontal disposition. The combination of the upwardly rounded portion and the foot engaging means causes the user's feet to be disposed at an angle between about 30° and about 60° with respect to the floor and causes the user's legs to assume a position where the angle between the user's calf and thigh is between about 40° and about 50°.

6 Claims, 4 Drawing Figures

TOILET CONSTRUCTION

This invention relates to an improved toilet construction and in particular it relates to a toilet construction wherein the user by necessity assumes a semisquatting position while seated on the toilet seat.

It is a well-known fact that the toilet constructions currently in use in the western world, including both the bowls and the toilet seats, are not designed to take full advantage of the user's physiological functions. Patents such as U.S. Pat. Nos. 3,520,005 and 3,786,522 discuss in detail some of the drawbacks of conventional toilet construction. As is indicated in such patents, conventional toilet construction not only interferes with blood circulation in the user's legs, but additionally, tends to compress the user's buttocks thereby hampering the defecation process.

In order to overcome some of these drawbacks of conventional toilet design, it is necessary for the user's body to assume a semi-squatting position where the user's legs, and hence the user's body, is disposed in the proper orientation which relieves the pressure on the user's legs and buttocks. It is believed that the strain encountered during use of conventional toilet facilities is one of the leading causes of hemorrhoids, a condition associated with strain and poor blood circulation.

It is an object of the present invention to overcome the difficulties and deficiencies associated with known forms of toilet and toilet seat cnstruction and to provide instead, an improved toilet construction which does not suffer from such drawbacks and deficiencies.

Another object of the present invention is to provide an improved toilet construction which necessarily causes the user to assume a semi-squatting position while seated thereon.

Another object of the present invention is to provide a toilet construction which positively positions both the user's thighs and the user's feet, thus controlling the angular disposition of the user's calf with respect to the user's thigh.

Another object of the present invention is to provide an improved toilet construction, which can be used on and in connection with toilet bowls or as an addition to conventional toilet bowls and toilet seats, and which is designed to facilitate the defecation process.

Another object of the present invention is to provide a simple and inexpensive addition to conventional toilets and toilet seats which will enable the user to assume a more proper physiological body position during the defecation process.

Other objects, advantages and saleant features of the present invention will become apparent from the following detailed description, which, taken in conjunction with the annexed drawings, discloses a preferred embodiment thereof.

The foregoing objects are attained by providing a toilet construction which uses a bulbous upwardly rounded portion at the forward end of a toilet seat to raise the user's thighs angularly upward from a horizontal position. An angled foot engaging means is provided at the forward lower portion of the toilet bowl for engagement by the user's feet to raise the user's feet angularly upward from a horizontal disposition. The combination of the bulbous upwardly rounded portion and the angled foot engaging means assures that the user's feet are disposed at an angle between about 30° and about 60° with respect to the floor and that the user's legs will assume a position where the angle between the user's calf and thigh is between about 40° and about 50°.

Referring now to the drawings, which form a part of this original disclosure:

Figure 1:
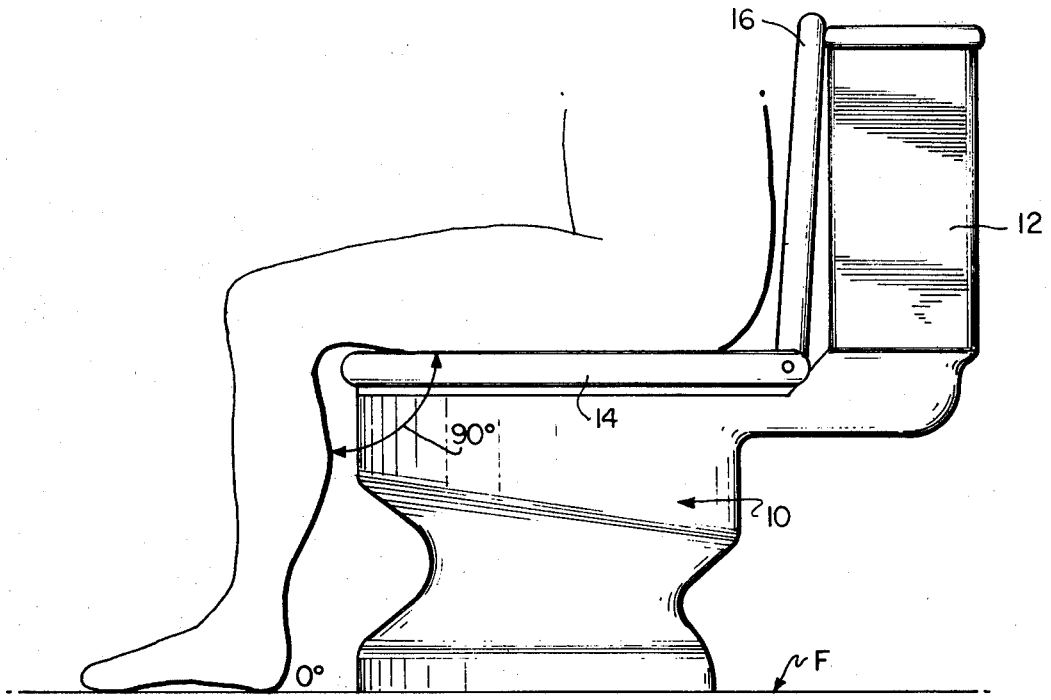
FIG. 1 is a side elevational view showing in diagrammatic form a conventional toilet construction of the type known in the prior art.

Referring now to FIG. 1, which illustrates the prior art, a conventional toilet bowl generally designated 10 is positioned upon a floor designated F. The toilet bowl 10 is provided with the usual form of upstanding tank 12 and with a conventional toilet seat having a horizontal buttocks engaging portion 14 and a hinged cover 16.

As shown in FIG. 1, the user's feet ordinarily rest flat on the floor when using such a conventional toilet, and as a result, the angle between the floor F and the bottom of the user's feet is usually zero degrees. Also, when the user's thighs rest on the toilet seat portion 14, the angle subtended between the user's calf and the user's thigh is approximately 90°, as illustrated. In this position, the user encounters excessive strain in attempting to achieve defecation, both because of the difficulty in contracting the internal muscles as well as in relaxing of the external sphincter muscle.

Figure 2:
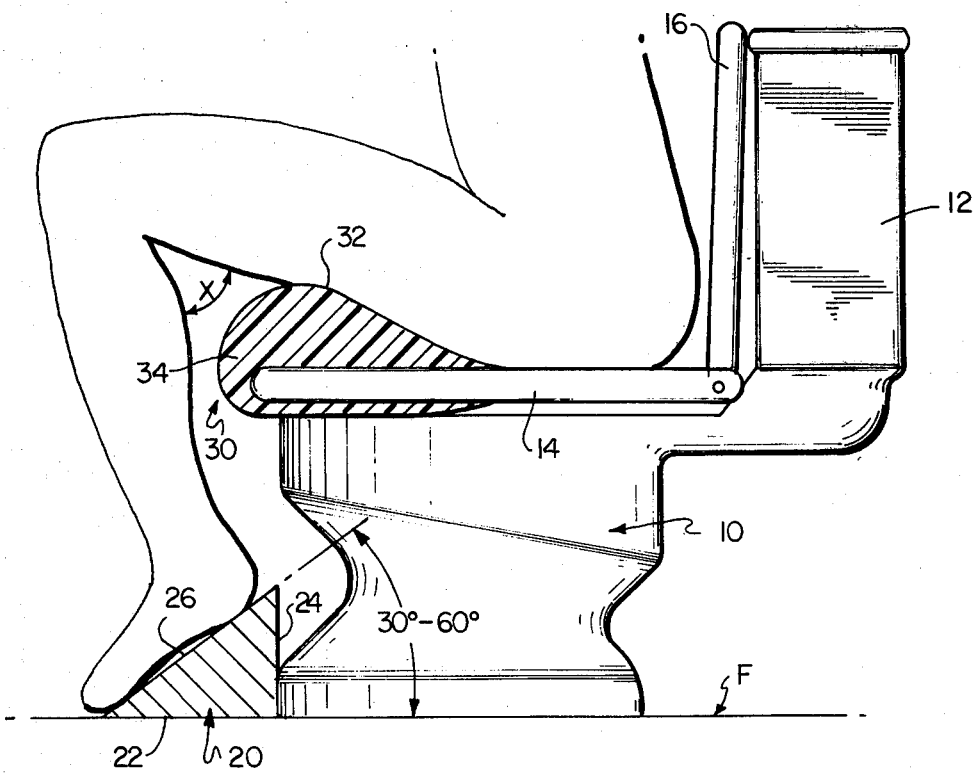
FIG. 2 is a diagrammatic view, partly in section, and similar to FIG. 1 but showing a toilet construction in accordance with the present invention.

Referring now to the present invention as illustrated in FIG. 2, it will be seen that the toilet bowl 10 and tank 12 are exactly the same as those illustrated in FIG. 1 and are positioned on the floor F. However, an angled foot engaging means generally designated 20 is provided at the lower forward end of the toilet bowl for engagement by the user's feet. The means 20 includes a flat bottom 22 which rests upon the floor F, a vertically upstanding wall 24 which abuts against the front of the toilet bowl, and an angularly disposed surface 26 extending between the upper end of the wall 24 and the forward end of the wall 22. This member 20, which can also be regarded as an angled step member, is designed so that the angled surface 26 thereof forms an angle of between about 30° and about 60° with respect to the floor. As a result, when the user's feet engage the surface 26, the user's heels are raised and the user's feet are disposed at a similar angle with respect to the floor.

In FIG. 2, the toilet seat 14 is the same as the conventional toilet seat illustrated in FIG. 1. However, it is provided with an elevated configuration generally designated 30 adjacent the forward end thereof to raise the user's thighs angularly upward from a horizontal disposition. The elevated configuration 30 comprises a bulbous upwardly rounded portion 32 extending above the toilet seat near the forward end thereof. The entire bulbous portion 32 is part of a member 34 which can be adhered to the forward end of a conventional toilet seat 14 and which can be formed of rubber, plastic or other suitable material. Advantageously, the member 34 can be formed of foam rubber or foam plastic to thus provide comfort to the user. The means 34 can be adhered to the conventional toilet seat 14 or can merely be slid over and applied freely to the end thereof.

In any event, as can be seen from FIG. 2, as a result of the bulbous upwardly rounded portion 32, the user's thighs are raised upwardly from the horizontal disposition of the toilet seat 14 and, in combination with the foot engaging means 20, cause an angle designated "x" to be subtended between the user's calf and the user's thigh. This angle "x" is between about 40° and about 50° and is advantageously 45°. When the user thus sits on the toilet construction shown in FIG. 2, his or her body is forced to assume the illustrated semi-squatting position which is physiologically advantageous and which assists in enabling the user to achieve the defecation process without undue strain.

Figure 3:
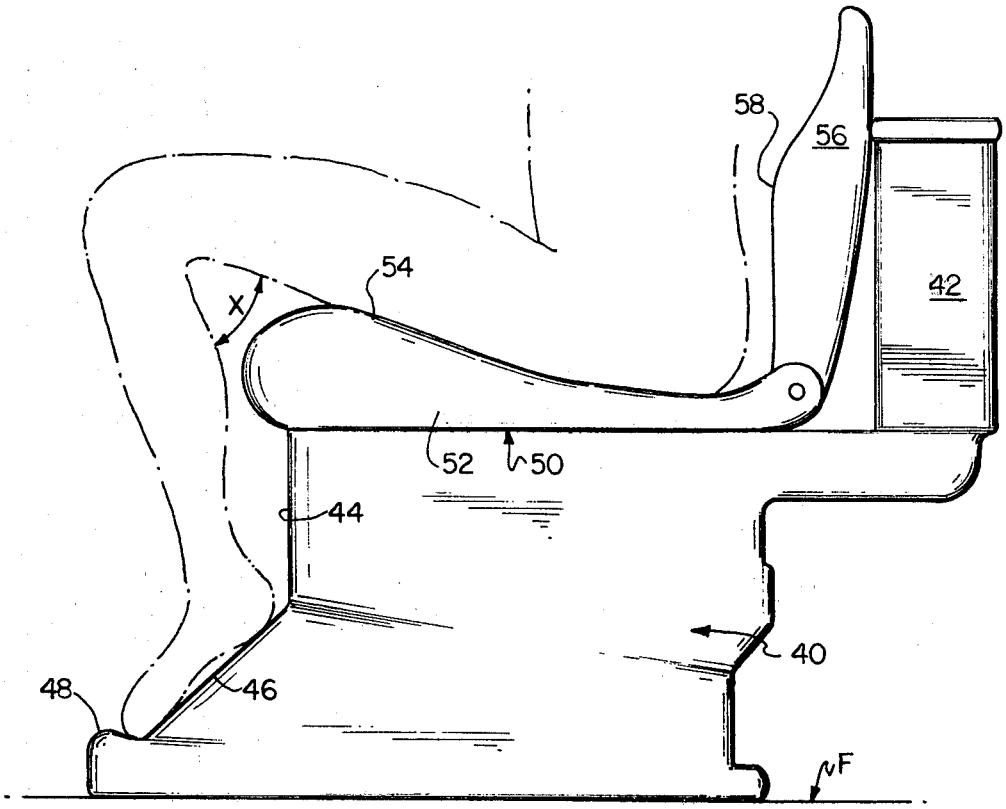
FIG. 3 is a diagrammatic side elevational view, similar to FIG. 2, but showing a modification of the present invention.

Referring now to FIG. 3, there is illustrated therein a modified form of toilet bowl 40 having an upstanding tank 42 attached at the rear thereof. The forward surface 44 of the toilet bowl is provided with an integrally formed angled foot engaging means 46 which is disposed at an angle of between about 30° and about 60° with respect to the floor F. The surface 46 forms an angled step member which can be engaged by the user's feet. The surface 46 terminates at a small abuttment surface 48 against which the user's toes can rest while his or her feet are engaged against the angled surface 46.

Figure 4:
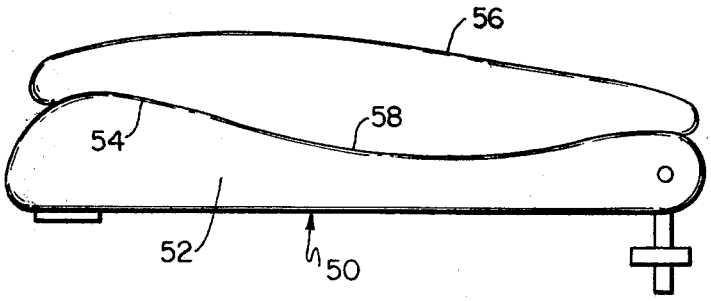
FIG. 4 is a side elevational view of the toilet seat used in the FIG. 3 modification of the present invention.

The embodiment of FIG. 3 also uses a modified toilet seat, as illustrated both in FIGS. 3 and 4. This toilet seat generally designated 50 includes a lower buttocks engaging portion or seat portion 52 which has an elevated configuration adjacent the forward end thereof. This elevated configuration is in the form of a bulbous upwardly rounded portion 54, similar or identical in configuration to the bulbous portion 32 illustrated in FIG. 2. As a result, when the user sits upon the modified toilet seat 50 shown in FIGS. 3 and 4 and rests his or her feet against the angled step member 46 formed integrally with the modified toilet bowl 40, the user's body assumes the desired semi-squatting position and the angle subtended between the user's calf and thigh is once again the same angle "x" as previously defined, namely, an angle of between about 40° and about 50°, and advantageously 45°.

Because of the unusual configuration of the toilet seat 52, the toilet seat back 56 must also have an unusual configuration. Thus, the back 56 is provided with a curved back engaging portion 58 against which the user's back can rest, if necessary, while the user is seated on the toilet of FIG. 3. However, when the toilet seat cover 56 is closed, the portion 58 assures that it will mate and engage against the top of the toilet seat portion 52.

The various changes apparent to those skilled in the art may be made without departing from the spirit and scope of the invention as defined in the appended claims.

What is claimed is:

1. An improved toilet construction comprising:

a toilet seat means adapted to fit upon a conventional toilet bowl;

said toilet seat means having an elevated configuration adjacent the forward end thereof to raise the user's thighs angularly upward from a horizontal disposition; and an angled foot engaging means disposed along the lower forward portion of the toilet bowl;

said foot engaging means sloping forwardly and downwardly from said lower forward portion of the toilet bowl;

said foot engaging means being adapted for engagement by the user's feet to raise the user's heels upward and to thus angularly raise the user's feet from a horizontal disposition.

2. An improved toilet construction as defined in claim 1 wherein said foot engaging means causes the user's feet to be disposed at an angle of between about 30° and about 60° elevated from horizontal and wherein said elevated configuration of said toilet seat means causes the user's thigh to form an angle of between about 40° and about 50° with the user's calf.

3. An improved toilet construction as defined in claim 2 wherein said elevated configuration of said toilet seat means comprises a bulbous upwardly rounded portion at the forward end of the toilet seat.

4. An improved toilet construction as defined in claim 3 wherein said foot engaging means is an angled step member, the upper surface of which is disposed at an angle of between about 30° and about 60° with respect to the floor.

5. An improved toilet construction as defined in claim 4 wherein said bulbous upwardly rounded portion is a separate member adapted to be coupled to a conventional toilet seat and wherein said angled step member is a separate member disposed adjacent to the front of the toilet bowl.

6. An improved toilet construction as defined in claim 4 wherein said bulbous upwardly rounded portion forms a part of the toilet seat and wherein said angled step member is integrally formed along the forward lower surface of said toilet bowl.

* * * * *